US005617113A

United States Patent [19]

Prince

[11] Patent Number: 5,617,113

[45] Date of Patent: Apr. 1, 1997

[54] MEMORY CONFIGURATION FOR DISPLAY INFORMATION

[75] Inventor: Dennis W. Prince, Banks, Oreg.

[73] Assignee: In Focus Systems, Inc., Wilsonville, Oreg.

[21] Appl. No.: 316,086

[22] Filed: Sep. 29, 1994

[51] Int. Cl.[6] ..... G09G 3/36

[52] U.S. Cl. ..... 345/103; 345/98

[58] Field of Search ..... 345/87, 94, 98, 345/103, 100, 92, 93, 97; 359/54, 56, 57

[56] References Cited

U.S. PATENT DOCUMENTS

| | | | |
|---|---|---|---|
| 4,630,122 | 12/1986 | Morokawa | 345/100 |
| 4,740,786 | 4/1988 | Smith | 345/103 |
| 4,745,485 | 5/1988 | Iwasaki | 345/98 |
| 4,816,816 | 3/1989 | Usui | 345/103 |
| 4,908,710 | 3/1990 | Wakai et al. | 345/103 |
| 5,262,881 | 11/1993 | Kuwata et al. | 359/55 |
| 5,387,923 | 2/1995 | Mattison et al. | 345/103 |

FOREIGN PATENT DOCUMENTS

| | | | |
|---|---|---|---|
| 0368572 | 5/1990 | European Pat. Off. | 345/98 |
| 0507061A2 | 10/1992 | European Pat. Off. | G09G 3/36 |
| 0569974A2 | 11/1993 | European Pat. Off. | G09G 3/36 |

*Primary Examiner*—Chanh Nguyen
*Attorney, Agent, or Firm*—Stoel Rives LLP

[57] ABSTRACT

Image data or addressing signal information for a dual-scan display (110, 168) is stored in three half-frame buffers (114*a*, 114*b*, and 114*c*; 172*a*, 172*b*, and 172*c*). Each of two buffers contains complete display information, comprising either image data or column signal data, for section 126B or 126T of the display. The third buffer receives and stores image data or column signals for a subsequent frame for one of the two display sections. By offsetting the frame periods of the two independent display sections, both display sections have display information corresponding to a complete frame without requiring two complete frame buffers, thereby reducing cost, size, and complexity of the display.

17 Claims, 5 Drawing Sheets

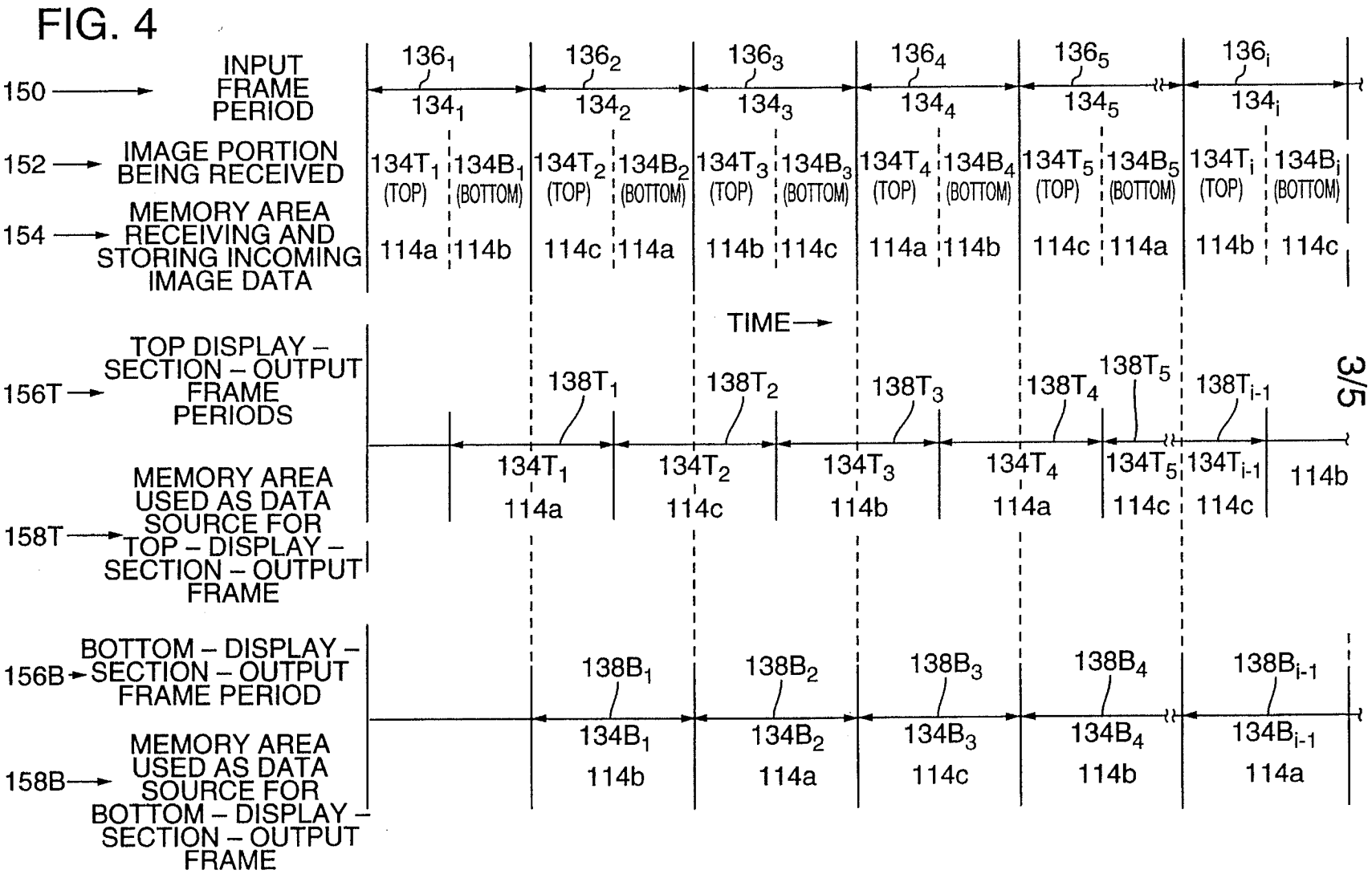
3/5
FIG. 4
150
INPUT FRAME PERIOD
152
IMAGE PORTION BEING RECEIVED
154
MEMORY AREA RECEIVING AND STORING INCOMING IMAGE DATA
156T
TOP DISPLAY – SECTION – OUTPUT FRAME PERIODS
158T
MEMORY AREA USED AS DATA SOURCE FOR TOP – DISPLAY – SECTION – OUTPUT FRAME
156B
BOTTOM – DISPLAY – SECTION – OUTPUT FRAME PERIOD
158B
MEMORY AREA USED AS DATA SOURCE FOR BOTTOM – DISPLAY – SECTION – OUTPUT FRAME
TIME
$136_1$ $136_2$ $136_3$ $136_4$ $136_5$ $136_i$
$134_1$ $134_2$ $134_3$ $134_4$ $134_5$ $134_i$
$134T_1$ (TOP) $134B_1$ (BOTTOM)
$134T_2$ (TOP) $134B_2$ (BOTTOM)
$134T_3$ (TOP) $134B_3$ (BOTTOM)
$134T_4$ (TOP) $134B_4$ (BOTTOM)
$134T_5$ (TOP) $134B_5$ (BOTTOM)
$134T_i$ (TOP) $134B_i$ (BOTTOM)
114a 114b 114c
$138T_1$ $138T_2$ $138T_3$ $138T_4$ $138T_5$ $138T_{i-1}$
$138B_1$ $138B_2$ $138B_3$ $138B_4$ $138B_{i-1}$
$134B_1$ $134B_2$ $134B_3$ $134B_4$ $134B_{i-1}$

INDIVIDUAL MEMORY AREA CYCLE

INDIVIDUAL DISPLAY SECTION CYCLE

MEMORY CONFIGURATION FOR DISPLAY INFORMATION

TECHNICAL FIELD

This invention relates to display information storage in flat panel displays and, in particular, to display information storage in passive matrix, dual-scan, liquid crystal displays.

BACKGROUND OF THE INVENTION

Flat panel displays are used in a wide variety of applications, such as televisions, notebook computers, projection systems, and cellular telephones.

FIGS. 1 and 2 shows a typical passive matrix flat panel display system 10 that includes a liquid crystal panel 12, in which a set of first transparent electrodes 22 are arranged in horizontal rows on the surface 18 of a first glass plate 14, and a set of second transparent electrodes 24 are arranged in vertical columns on the opposing surface 20 of a second glass plate 16, positioned parallel to and spaced apart from first glass plate 14. An electro-optical material 28, such as a liquid crystal, is sandwiched between plates 14 and 16; and a matrix comprising a large number of individually controllable picture elements 30, or "pixels," is defined wherever a first, or row, electrode 22 and a second, or column, electrode 24 overlap. Some displays, known as "dual-scan" displays, include two sets of column electrodes 24 separated by a non-conducting gap 40. Each set of column electrodes 24 overlaps only half of the total number of row electrodes 22, thereby forming two independently addressed display sections 42*a* and 42*b*, each comprising a separate, independent matrix of pixels 30.

A complete image is typically displayed during a time interval known as a "frame period," which lasts approximately one-sixtieth of a second. The optical state of each pixel 30, which is determined by the root mean square ("rms") of the potential difference between the row and column electrodes 22 and 24 over the frame period, is controlled by applying electrical addressing signals to row and column electrodes 22 and 24. The large number of pixels 30 allows the formation of arbitrary information patterns in the form of text or graphic images.

Addressing signals determined in accordance with any number of addressing techniques are applied to the electrodes by addressing signal voltage drivers, known as "LCD (liquid crystal display) drivers." Row electrodes 22 are typically "selected," i.e., have a nonzero, image-independent voltage applied, during one or more of the "addressing intervals" that comprise the frame period. Image-dependent column signals determined in accordance with the addressing technique are applied to the column electrodes 24 in each addressing interval. The application of the row addressing signals that cause selections of row electrodes 22 are coordinated with the application of the column signals to produce across each pixel during the addressing interval voltages that result in an rms voltage value over the frame period corresponding to the desired optical state of the pixel 30.

In some addressing techniques, row electrodes 22 are selected sequentially, a single row at a time, and each column signal during any addressing interval depends only upon the desired state of the pixel in that column corresponding to the single selected row. In more modern addressing techniques, such as Active Addressing™ techniques, multiple rows are simultaneously selected and each column signal is determined by the desired states of multiple pixels 30 in the column corresponding to the selected rows.

Because each row is selected multiple times with the selections distributed over the frame period, image data corresponding to the multiple pixels must be available throughout the entire frame period to calculate the column signals. With such techniques, the rms value across individual pixels 30 during a frame period will be correct only if pixel values for the multiple pixels 30 in each column are not changed throughout the frame period. The entire frame of image data, therefore, must be stored and available for use in the calculations for a complete frame period. If the image data is changed during an frame period, the rms voltage will not be correct and image degradation will result.

A large quantity of data is associated with the image for each frame. A typical liquid crystal display may have 480 rows and 640 columns that intersect to form a matrix of 307,200 pixels. It is expected that matrix liquid crystal displays may soon comprise several million pixels. The state of each pixel, i.e., its color or shade of gray, is described by several bits of data, the exact number of bits depending upon the desired number of colors or gray levels. Because of the large number of pixels and multiple bits required to specify the optical state of each pixel, a large amount of image data is required to characterize the image of each frame.

Because it is not possible to receive an entire set of image frame data and calculate the column signals in the short period of time available between frames, it is generally necessary to have sufficient data storage associated with the display to store two complete frames of image data. One complete frame of image data is made available for calculating column signals, while image data for the subsequent frame is simultaneously being received and stored in another memory location.

To reduce the size, cost, and complexity of liquid crystal displays, it is desirable to reduce the amount of data storage required, but because modern addressing techniques require the same image data from multiple pixels in each column to be available during multiple addressing intervals, it has not been possible to reduce the data storage requirements for such displays below two complete frames.

SUMMARY OF THE INVENTION

An object of the present invention is, therefore, to reduce data storage requirements for flat panel displays.

Another object of this invention is to reduce data storage requirements for such displays without causing observable image degradation.

The present invention is an apparatus and a method for reducing the data storage requirements in a display system, particularly in a dual-scan, multiplexed liquid crystal display. Such a display has first and second sections that independently display two portions, typically the bottom and top halves, of an image.

According to the present invention, three memory areas or buffers, each having sufficient memory to store display information corresponding to one-half of an entire image, rotate their functions between receiving display information and supplying the display information to the first and second sections of the dual-scan display. In one embodiment, the display information received by and stored in the memory buffers is image data, which is then supplied to an image data processor to determine addressing signals that produce the desired image. In a second embodiment, the display information received by the memory buffers is column signal data already determined from the image data. Column signal data is provided to LCD column drivers, which apply corresponding column signals to the column electrodes of the display sections.

A display system typically receives image data for each frame as a series of sequential images from an external source. In the first embodiment, the incoming image data are stored during an input frame period. Half of the image data are stored in one memory area, and the other half of the image data are stored in another memory area. The first display section displays its portion of the image during a series of first-display-section-output frame periods, and the second display section displays its portion of the image during a series of second-display-section-output frame periods. The first- and second-display-section-output frame periods are typically of the same duration but temporally offset or out of phase with each other. For example, the first-display-section-output frame period may lead the second-display-section-output frame period by one-half of a frame period.

While two of the three memory areas contain complete image data for two image portions and provide the data to an image data processor to generate addressing signals for the two display sections, image data corresponding to the subsequent frame for the display section that will next complete its current frame is being received and stored in the third memory area. When a current display-section-output frame is completed, complete image data for the next image for that display section is, therefore, available for the calculation of addressing signals for the next display-section-output frame.

By rotating the function of each memory buffer and offsetting the frame periods of the two display sections, each display section has available to it at all times during the output frame period a complete set of image data. The column signals for each section of the display are, therefore, determined using data from a complete image for that section of the display, and the rms voltage is correct over the frame period.

In the second embodiment, incoming image data is not stored in one-half frame memory buffers, but is provided to an image data processor to be used in the determination of column signal data. Column signal data for a complete frame period for one display section are stored in one memory buffer as image data are processed. The memory buffers rotate between storing column signal data and providing column signal information to the two display sections in a manner similar to that described above with respect to the first embodiment.

The present invention is applicable to any display system comprising "n" independently addressed displays or display sections and at least n+1 memory areas, each memory area having the capacity and bandwidth to store and provide sufficient display data for an independently addressed display. The frame periods for each display are temporally offset from those of the other displays and a rotating one of the memory buffers stores image data for use by the display whose frame period will be completed next. Each of the n displays, therefore, has available to it at all times display data for a complete image and, upon completion of the frame period of any display, complete display data is available to begin the next frame.

Additional objects and advantages of the present invention will be apparent from the following detailed description of preferred embodiments thereof, which proceeds with reference to the accompanying drawings.

BRIEF DESCRIPTION OF THE DRAWINGS

FIG. 4 is a schematic timing diagram that shows the functioning of the memory buffers of the embodiment of FIG. 3.

DETAILED DESCRIPTION OF THE PREFERRED EMBODIMENTS

Figure 1:
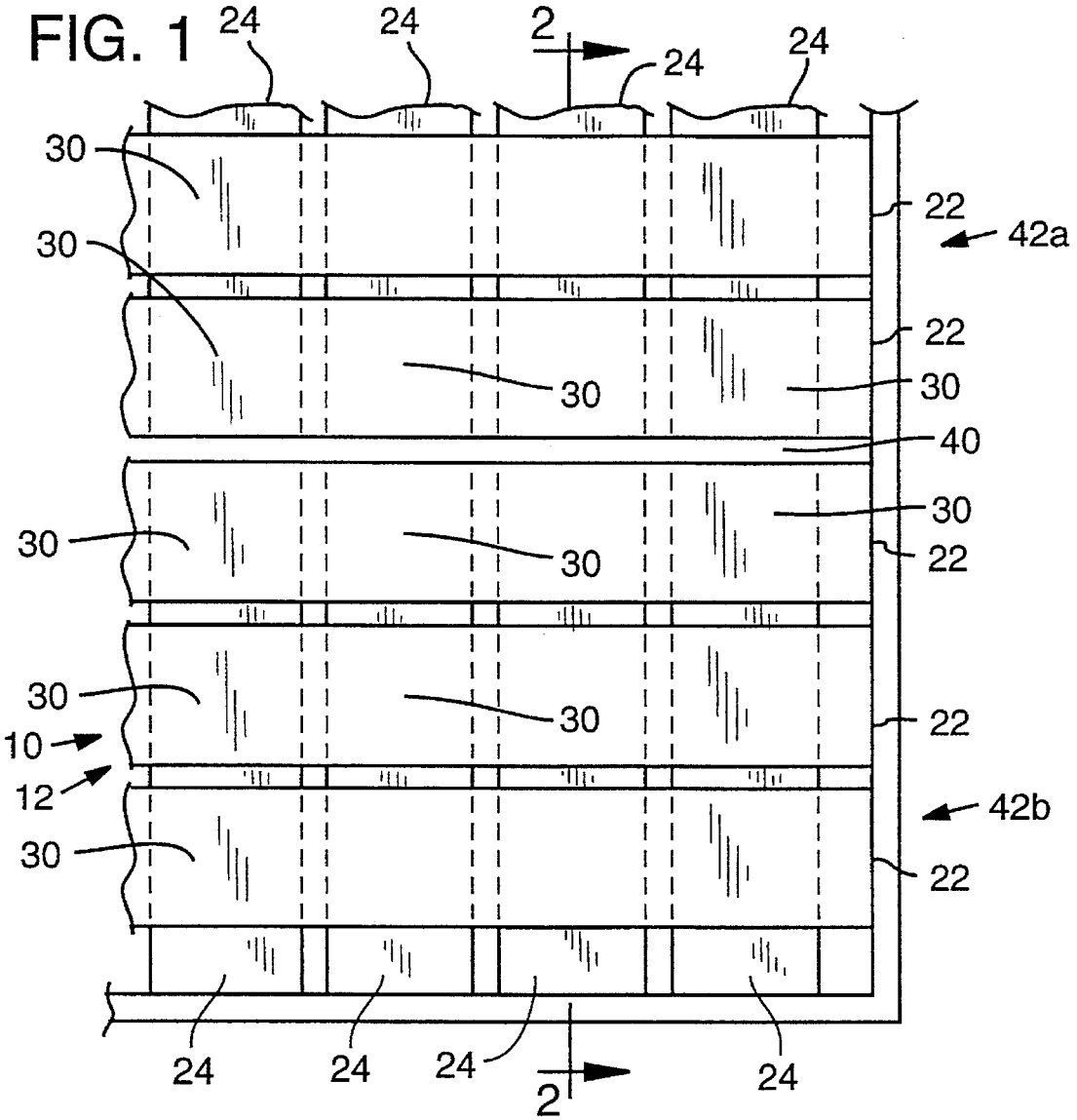
FIG. 1 is a diagrammatic, fragmentary plan view of a typical liquid crystal display that can be used with the present invention.
Figure 2:
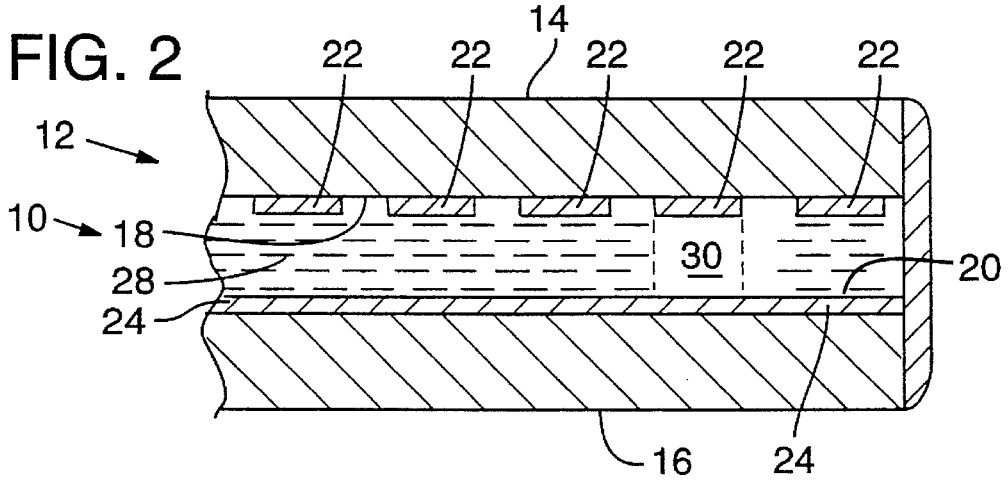
FIG. 2 is a sectional view taken along lines 2—2 of FIG. 1.
Figure 3:
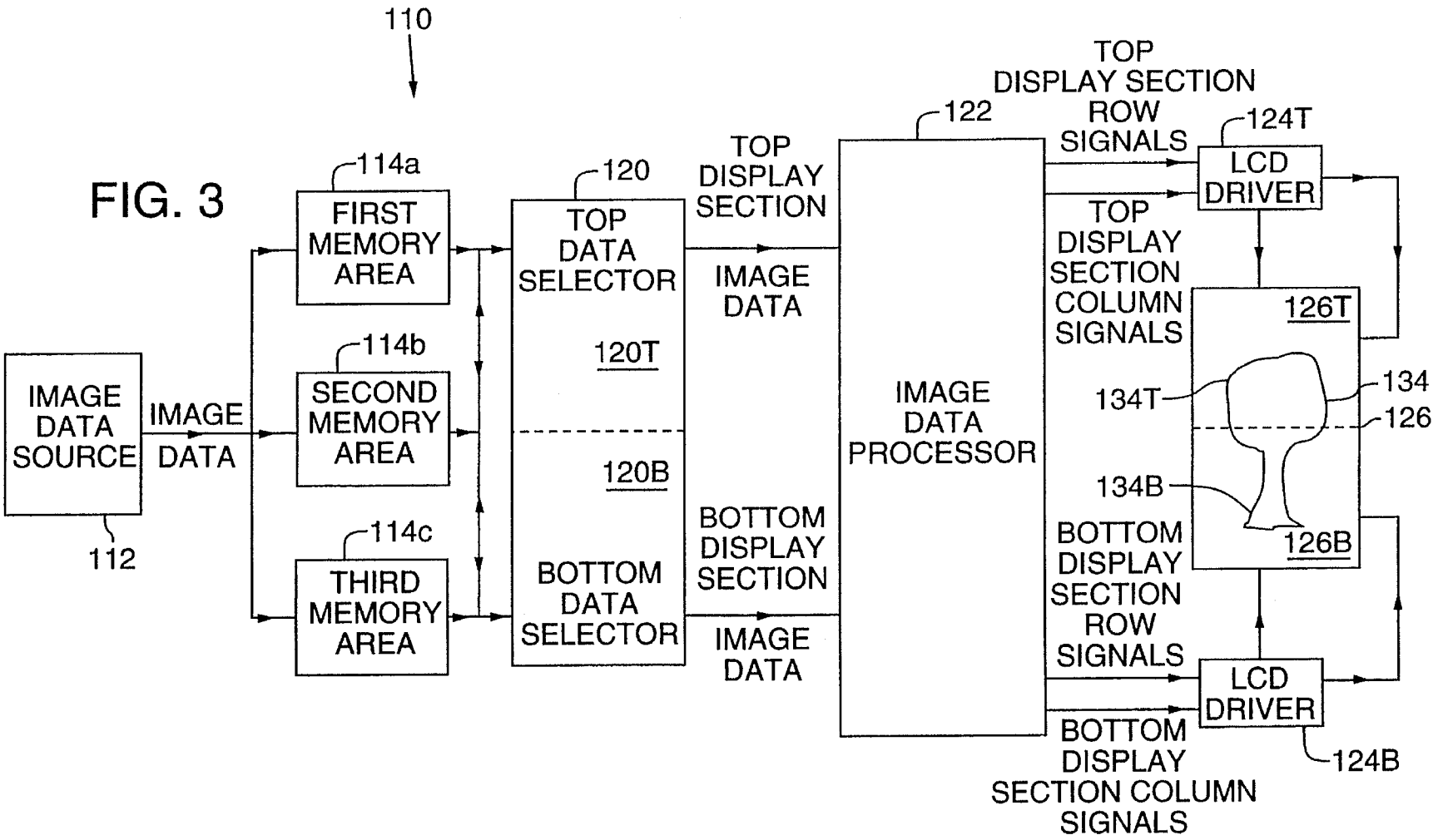
FIG. 3 is a block diagram showing the components of a first embodiment of liquid crystal display incorporating the present invention.

FIG. 3 is a block diagram showing the components of a first embodiment of a dual scan liquid crystal display 110 that incorporates the principles of the present invention. An image data source 112, such as a computer or a television receiver, provides image data for a sequence of images. The image data are stored cyclically in one of first, second, and third memory areas or buffers 114*a*, 114*b*, and 114*c*. Although memory buffers 114*a*, 114*b*, and 114*c* are shown as separate components, the invention could also be implemented with an integrated memory in which the buffers are not physically separated. Each of memory buffers 114*a*, 114*b*, and 114*c* could also be implemented using several integrated circuit memories to provide the required memory capacity and bandwidth, which will vary with the size and type of the display. The form of memory buffers 114*a*, 114*b*, and 114*c* is a design choice that a skilled person can readily make based upon the memory products available.

A data selector 120 comprising a top data selector 120T and a bottom data selector 120B receives display information in the form of image data from the appropriate one of memory buffers 114*a*, 114*b*, and 114*c* for use by an image data processor 122. Image data processor 122 typically provides image independent row addressing signals and calculates image dependent column addressing signals for application via LCD drivers 124T and 124B alternately to the respective top section 126T and bottom section 126B of liquid crystal panel 126. Application of the addressing signals results in an image 134 being displayed on liquid crystal panel 126, with a top portion 134T of image 134 being displayed on top display section 126T and the bottom portion 134B of image 134 being displayed on bottom display section 126B.

By temporally offsetting the output frame period for top and bottom display sections 126T and 126B, each display section always has available to it data for a complete image portion, while the third memory area is receiving and storing image data for the display section that will next complete its current output frame period. When a display section completes its output frame period, it begins using data from the memory area that last completed receiving and storing image data. The memory area that contained data for the completed frame period is now free to receive and store new incoming data. In this manner, complete image data is always available to both display sections, without requiring memory capacity to store image data corresponding to two complete frame periods for each display area. A typical dual scan display, therefore, requires sufficient memory only to store one and one half display images.

FIG. 4 is a schematic timing diagram showing the temporal relationships among various activities, shown as lines 150–158, of a preferred embodiment of the present invention. FIG. 4 shows that memory buffers 114*a*, 114*b*, and 114*c* in turn receive and store image data corresponding to a series of images $\mathbf{134}_i$ during input frame periods $\mathbf{136}_i$. Memory buffers 114*a*, 114*b*, and 114*c* then supply the image data through top and bottom data selectors 120T and 120B to image data processor 122 for calculating during top- and bottom-display-section-output frame periods $\mathbf{138T}_i$ and $\mathbf{138B}_i$ addressing signals to produce image portions $\mathbf{134T}_i$ and $\mathbf{134B}_i$ on respective top 126T and bottom 126B sections of display 126.

Lines 150 and 152 show that image data corresponding to a series of images $\mathbf{134}_i$ are supplied sequentially from image data source 112 during sequential input frame periods $\mathbf{136}_i$. Line 152 shows that for each frame period in the series, image data source 112 alternately supplies image data for top image portion $\mathbf{134T}_i$ and bottom image portion $\mathbf{134B}_i$ of the same image $\mathbf{134}_i$.

Line 154 shows that during serial input frame periods $\mathbf{136}_i$, image data corresponding to top and bottom image portions $\mathbf{134T}_i$ and $\mathbf{134B}_i$ are stored in memory buffers 114*a*, 114*b*, and 114*c* in repetitive sequence. It will be understood that the incoming data are typically reformatted to strip away command and control signals and to make the image data compatible with the data requirements of image data processor 122.

Lines 156T and 156B show that top and bottom display sections 126T and 126B display respective image portions $\mathbf{134T}_i$ and $\mathbf{134B}_i$ during respective top- and bottom-display-section-output frame periods $\mathbf{138T}_i$ and $\mathbf{138B}_i$. Lines 158T and 158B show that respective top and bottom data selectors 120T and 120B select data cyclically, i.e, repetitively and in turn, from buffers 114*a*, 114*b*, and 114*c* to provide complete image data corresponding to image portions $\mathbf{134T}_i$ and $\mathbf{134B}_i$ to image data processor 122 for use in calculating addressing signals for the top and bottom sections 126T and 126B.

For example, during the first half of input frame period $\mathbf{136}_1$, image data corresponding to top image portion $\mathbf{134T}_1$ for the input frame period $\mathbf{136}_1$ are received from image data source 112 and stored in memory buffer 114*a*. During top-display-section-output frame period $\mathbf{138T}_1$, image data previously stored in memory buffer 114*a* and corresponding to top image portion $\mathbf{134T}_1$ are selected by data selector 120T for use in generating addressing signals for top section 126T. During the second half of input frame period $\mathbf{136}_1$, image data corresponding to the bottom portion $\mathbf{134B}_1$ of image $\mathbf{134}_1$ are received from image data source 112 and stored in memory buffer 114*b*.

During the first half of the next input frame period $\mathbf{136}_2$, image data corresponding to a top image portion $\mathbf{134T}_2$ of a next image $\mathbf{134}_2$ are received from image data source 112 and stored in memory buffer 114*c*, while top selector 120T continues to provide image information corresponding to top image portion $\mathbf{134T}_1$ from buffer 114*a* to data processor 122 for determining addressing signals for top section 126T during top-display-section-output frame period $\mathbf{138T}_1$. During bottom-display-section-output frame period $\mathbf{138B}_1$, the image data corresponding to image portion $\mathbf{134B}_1$ stored during the second portion of input frame period $\mathbf{136}_1$ in memory buffer 114*b* are selected by data selector 120B for use in generating addressing signals for bottom section 126B.

The bottom-display-section-output frame periods $\mathbf{138B}_i$ are, therefore, temporally offset or out of phase by one-half of a display-section-output frame period with respect to the corresponding top-display-section-output frame periods $\mathbf{138T}_i$. The top-display-section-output frame periods $\mathbf{138T}_i$ are one-half of a display-section-output frame period behind in phase with respect to the corresponding input frame period $\mathbf{136}_i$, and the bottom-display-section-output frame period $\mathbf{138T}_i$ is, therefore, one full display-section-output frame period behind in phase with respect to the corresponding input frame period $\mathbf{136}_i$.

During top-display-section-output frame period $\mathbf{138T}_2$, top selector 120T selects from memory buffer 114*c* image data corresponding to top image portion $\mathbf{134T}_2$ and provides the image data to data processor 122 for determining addressing signals for top section 126T. Memory buffer 114*a*, which is no longer providing image data to data processor 122, begins to store image data corresponding to the bottom image portion $\mathbf{134B}_2$ during the second half of input frame period $\mathbf{136}_2$. Bottom selector 120B continues to provide image information corresponding to bottom image portion $\mathbf{134B}_1$ from memory buffer 114*b* to data processor 122 for determining addressing signals for bottom section 126B.

During bottom-display-section-output frame period $\mathbf{138B}_2$, bottom selector 120B selects from buffer 114*a* image data corresponding to bottom image portion $\mathbf{134B}_2$ and provides the image data to data processor 122 for determining addressing signals for bottom section 126B. Memory buffer 114*b*, which is no longer providing image data to data processor 122, begins to store image data corresponding to the top image portion $\mathbf{134T}_3$ during the first half of input frame period $\mathbf{136}_3$. Top selector 120T continues to provide image information corresponding to top image portion $\mathbf{134T}_2$ from buffer 114*c* to data processor 122 for determining addressing signals for top section 126T during top $\mathbf{138T}_2$.

Figure 5:
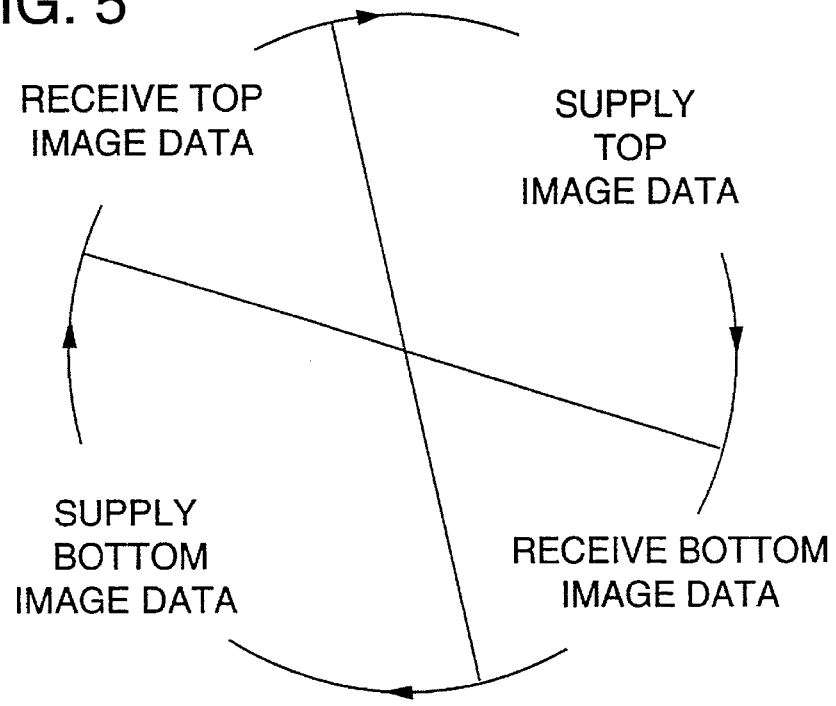
FIG. 5 is a diagram showing the cyclical uses of each of the multiple memory areas of the embodiment of FIG. 3.
Figure 6:
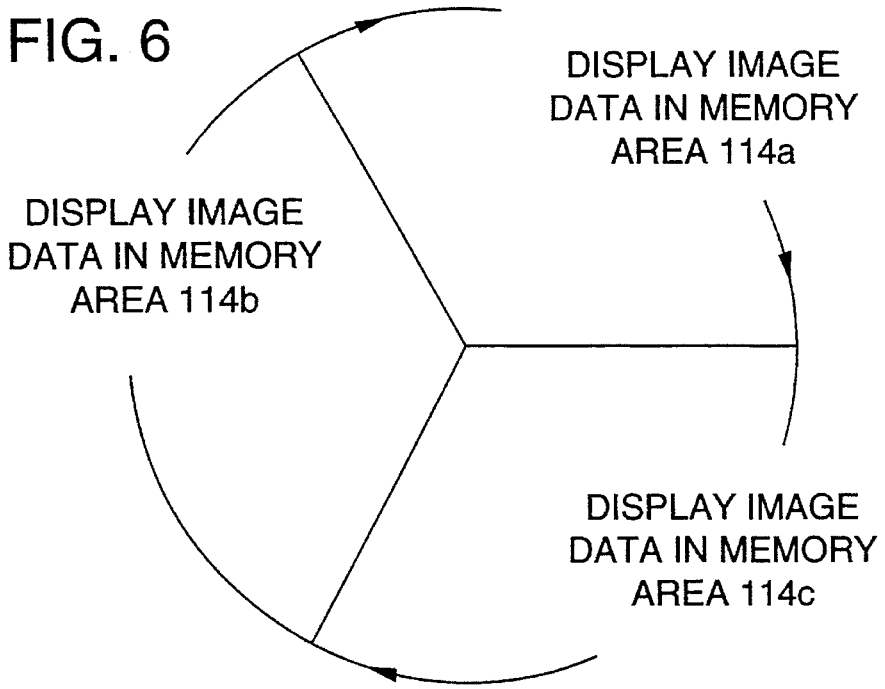
FIG. 6 is a diagram showing the sources of image data for either one of the top or bottom display sections of a display of the embodiment of FIG. 3.

As shown in FIG. 5, image data continue to be supplied from image data source 112 cyclically to buffers 114*a*, 114*b*, and 114*c*, each of which alternates between receiving top image data from image data source 112, supplying image data for top section 126T, receiving bottom image data from data source 112, and supplying image data for bottom section 126T. After every three input frame periods, the cycle is repeated and a top image portion $\mathbf{134T}_i$ is again received and stored in buffer 114*a*. FIG. 6 shows the cycle of each display section. Because data processor 122 always has a complete set of image data for the separately addressed display sections 126T or 126B, the addressing signals calculated for each top- or bottom-display-section-output frame periods $\mathbf{138T}_i$ and $\mathbf{138B}_i$ will produce the desired rms voltage across the individual pixels during every frame.

Data processor 122 uses the image information provided by data selectors 120T and 120B to determine in accordance with an addressing technique signals to be applied to display sections 126T and 126B. The addressing signals determined in data processor 122 are applied to row, or first, electrodes and column, or second, electrodes using LCD drivers 124T and 124B. A preferred implementation of display 110 determines addressing signals in accordance with an Active Addressing™ addressing technique, such as the one described in U.S. patent application Ser. No. 07/678,736, which is assigned to the assignee of the present invention, or the technique described in U.S. Pat. No. 5,262,881 to Kuwata et al.

Figure 7:
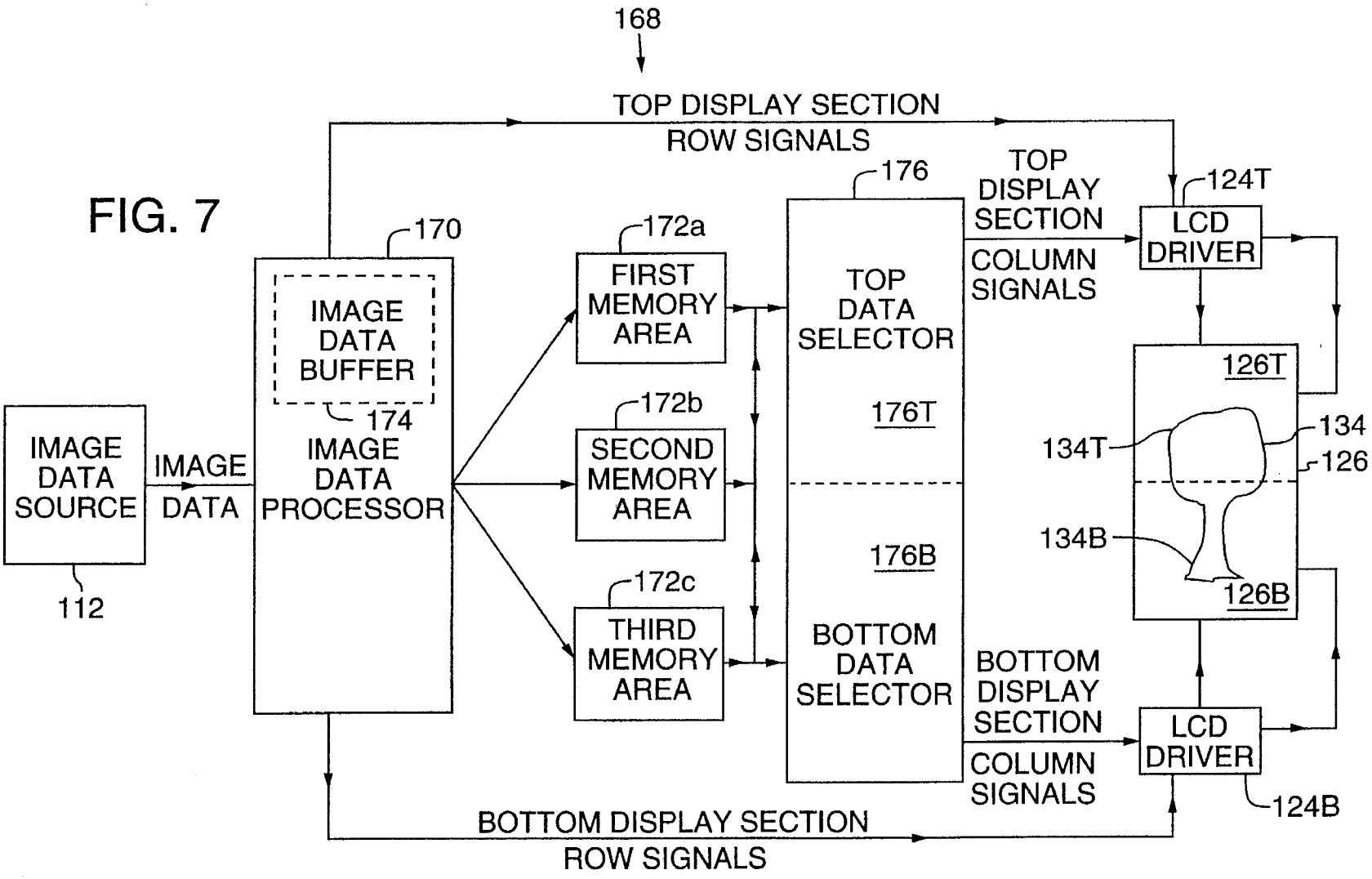
FIG. 7 is a block diagram showing the components of a second embodiment of liquid crystal display incorporating the present invention.

FIG. 7 is a block diagram, similar to that of FIG. 3, but showing a display 168 that represents a second preferred embodiment, in which the stored display information represents column signal data, rather than image data. Display 168 includes an image data processor 170 that receives image data from image data source 112. Image data processor 170 determines column signal data, which are stored in one of memory buffers 172*a*, 172*b* or 172*c*. In some embodiments, image data processor 170 includes an image data buffer 174 that temporarily stores image data corresponding to several rows.

In a typical embodiment using an Active Addressing™-type addressing system, the column signals are determined in the image data processor 170 by the incoming sequential image data and row signal function data. The incoming image datum for each pixel is combined with the row signal function data for the row defining the pixel, and the results are added to memory locations within one of memory buffers 172*a*, 172*b* or 172, with each individual memory location containing information for a single addressing interval for a single column of display section 126T or 126B. When image data processor 170 has received and processed image data corresponding to a complete image for a display section 126T or 126B, the column signal data stored in memory buffer 172*a*, 172*b* or 172*c* will contain, for each column, contributions from all the pixels in that column. Whether the image data from a particular pixel in a column contributes to the column signal during a particular addressing interval will typically depend upon whether the pixel is in a row selected during the particular addressing interval. In an addressing system such as the one described in copending U.S. patent application Ser. No. 07/883,002 for "Gray Level Addressing for LCDS" which is assigned to the assignee of the present invention, the image data may also be used to calculate correction factors used to adjust the column signal information.

When image data processor 170 has received and processed complete image data for a display section 126T or 126B, the memory buffer 172*a*, 172*b* or 172*c* will contain, for each column, column signal data corresponding to the voltage levels to be applied during addressing intervals of the frame period.

In a first implementation of the embodiment of FIG. 7, display 168 uses an Active Addressing technique that selects all rows during every time interval. The sums in the memory locations within memory buffers 172*a*, 172*b* or 172*c* do not represent the complete column signal data until image data for the last row of pixels is received, combined with its row signal data, and added to the corresponding memory locations. Until that point, memory buffers 172*a*, 172*b* or 172*c* contain only partial sums of the column signal data. This implementation requires that memory buffers 172*a*, 172*b* or 172*c* have sufficient bandwidth to perform a read-modify-write operation after every row of image data is received and combined with the row function data.

In a second implementation of the embodiment of FIG. 7, display 168 uses an Active Addressing™ addressing technique that selects "n" rows at a time, with n being less than the total number of rows. The value of n is typically less than 32, with n=7 preferred. Image data corresponding to n rows of data are stored in image data buffer 174 and complete column signal data for the addressing intervals in which the n rows are selected are calculated by image data processor 170 and stored in the memory locations within memory buffers 172*a*, 172*b* or 172*c*. Image data buffer 174 can be implemented using a FIFO buffer and memory buffers 172*a*, 172*b* or 172*c* do not require as large a bandwidth as in the first implementation. One skilled in the art will recognize that many variations on the above-described embodiments and implementations are possible, such as embodiments that store some image data or partial sums in image data buffer 174, and access memory buffers 172*a*, 172*b* or 172*c* less frequently than with every row of incoming data. In any of these embodiments, memory buffers 172*a*, 172*b* or 172*c* will eventually contain complete column signal data corresponding to addressing intervals for the columns of display sections 126T or 126B.

Column signal data corresponding to sequential incoming image data for top- and bottom-display-section-output frame periods are stored in turn in memory buffers 172*a*, 172*b* and 172*c*, which then supply column signal data alternately through a top data selector 176T and a bottom data selector 176B to respective drivers 124T and 124B, which provide column signals to respective display sections 126T or 126B. Storing and supplying of column signal data proceeds in a manner analogous to that shown in FIG. 4 and described above with respect to the FIG. 3 embodiment. Row signals are provided by image data processor 170 to respective drivers 124T and 124B for application to the row electrodes in coordination with the application of the column signals.

It will be understood that, because the display information representing the column signal data are of a form different from that of the display information representing image data, memory buffers 172*a*, 172*b*, and 172*c* may require a different capacity and bandwidth than those of memory buffers 114*a*, 114*b*, and 114*c*. The bandwidth requirements for the memory buffers 172*a*, 172*b* and 172*c* are typically less than those for memory buffers 114*a*, 114*b*, and 114*c*.

The invention is not limited to any particular addressing technique but is particularly useful with addressing techniques that select individual row electrodes multiple times throughout the display frame period, because such addressing techniques require a more complete set of image data to be available for calculating addressing signals.

It will be obvious that many changes may be made to the above-described details of the invention without departing from the underlying principles thereof. For example, display 110 or 168 could use four sections 126 to display a complete image, such as by juxtaposing two dual-scan displays side-by-side. Furthermore, the temporal offset between top- and bottom-display-section-output frame-periods is not limited to one-half the display frame period but could be any value that provides sufficient time to load one-half of a complete image into one of the memory buffers.

Although the invention has been exemplified using a display in which two independently addressed display sections display two different portions of a single image, it is clear that the invention is applicable to any two independently addressed displays, including two displays displaying unrelated images.

The invention can also be used to reduce data storage requirements in a system using more than two independently addressed displays. For example, in a display system comprising "n" independently addressed displays, n+1 memory buffers would be required and display frame periods for each display would be offset by 1/n of a display frame period. The quantity of independently addressed displays that can be used with a single extra memory buffer is limited only by the time required to load image information into the extra buffer.

The scope of the present invention should, therefore, be determined only by the following claims.

I claim:

1. A method for addressing a display including first and second display sections that display different parts of a single image corresponding to image data received by the display during an input frame period, each display section including independently overlapping first and second electrodes positioned on opposite sides of a display material to define an array of pixels that display during respective first- and second-display-section-output frame periods information patterns corresponding to the image, the method comprising:

storing during a first input frame period in a first memory area display information corresponding to a first portion of a first image;

applying to the first display section during a first first-display-section-output frame period addressing signals corresponding to the display information stored in the first memory area and storing during the first input frame period in a second memory area display information corresponding to a second portion of a first image;

applying to the second display section during a first second-display-section-output frame period addressing signals corresponding to the display information stored in the second memory area and storing during a second input frame period in a third memory area display information corresponding to a first portion of a second image;

applying to the first display section during a second first-display-section-output frame period addressing signals corresponding to the display information stored in the third memory area and storing during the second input frame period in the first memory area information corresponding to a second portion of a second image;

applying to the second display section during a second second-display-section-output frame period addressing signals corresponding to the display information stored in the first memory area and storing during a third input frame period in the second memory area display information corresponding to a first portion of a third image; and applying to the first display section during a third first-display-section-output frame period addressing signals corresponding to the display information stored in the second memory area and storing during the third input frame image in the third memory area image corresponding to a second portion of a third image.

2. The method of claim 1 in which the first-display-section-output frame periods and second-display-section-output frame periods corresponding to the first and second portions of the same image are temporally offset.

3. The method of claim 2 in which the second-display-section-output frame periods and the first-display-section-output frame periods are of the same duration and the first-display-section-output frame periods and second-display-section-output frame periods corresponding to different portions of the same image are temporally offset by approximately one-half of the first-display-section-output frame period.

4. The method of claim 1 in which each first-display-section-output frame period is temporally offset by one-half of a first-display frame period from the input frame period in which the corresponding data were stored and the second-display-section-output frame period is temporally offset by a complete first-display-section-output frame period from the input frame period in which the corresponding data were stored.

5. A method for addressing a display system that includes multiple, independently addressed display sections, each display section including independently overlapping first and second electrodes positioned on opposite sides of a display material to define an array of pixels that display information patterns corresponding to image data representing an image in a sequence of images, the display system storing image information corresponding to the image data in multiple memory areas, the method comprising:

applying to an ith display section during a first ith-display-section-output frame period addressing signals corresponding to display information stored in a jth memory area;

storing in an kth memory area display information corresponding to an image to be displayed in the ith display section in a second ith-display-section-output frame period;

applying during the second ith-display-section-output frame period to the ith display section addressing signals corresponding to the display information stored in the kth-memory area;

storing in the jth memory area display information corresponding to an image to be displayed in an i+1th display section in an i+1th-display-section-output frame period, the i+1th-display-section-output frame period being offset in phase from the ith-display-section-output frame period; and applying addressing signals to each of the multiple, independently addressed display sections as described above with respect to the ith display section, wherein different memory areas are used for storing data for subsequent display-section-output frame periods of the same display section, the display-section-output frame periods for different ones of the independently addressed display sections are offset in phase from each other, and none of the multiple display sections is addressed twice before each one of the multiple, independently addressed display sections are addressed once;

where the ith and the i+1th display sections are typical ones of the multiple, independently addressed display sections and the jth and kth memory areas are typical ones of the multiple memory areas.

6. The method of claim 5 in which the display system includes n independently addressed display sections and n+1 memory areas, where n is an integer.

7. The method of claim 6 in which n=2.

8. The method of claim 6 in which the display-section-output frame periods for different ones of the independently addressed sections are offset in phase from each other by 1/n of a display-section-output frame period.

9. The method of claim 5 in which the display system includes 4 independently addressed display sections.

10. The method of claim 5 in which different ones of the independently addressed display sections display different portions of the same image.

11. The method of claim 5 in which different ones of the independently addressed display sections display images that are not different portions of the same image.

12. A method for addressing a display including first and second display sections that display different parts of a single image corresponding to image data received by the display during an input frame period, each display section including independently overlapping first and second electrodes positioned on opposite sides of a display material to define an array of pixels that display during respective first- and second-display-section-output frame periods information patterns corresponding to the image, the method comprising:

storing during a first input frame period in respective first and second memory areas display information corresponding to respective first and second portions of a first image;

applying to the first and second display sections during respective first first-display-section-output and first second-display-section-output frame periods addressing signals corresponding to the display information stored in the respective first and second memory areas;

storing during a second input frame period in a third memory area and the first memory area image data corresponding to a respective first and second portions of a second image;

applying to the first and second display sections during respective second first-display-section-output and second second-display-section-output frame periods addressing signals corresponding to the image information stored in the respective third and first memory areas;

storing during a third input frame period in the second and third memory areas image data corresponding to first and second portions of a third image; and applying to the first and second display sections during third first-display-section-output and third second-display section-output frame periods addressing signals corresponding to the image information stored in the respective second and third memory areas.

13. The method of claim 12 in which the second-display-section-output frame period is offset by approximately one-half of a display-section-output frame period duration from the first-display-section-output frame period.

14. The method of claim 12 in which applying addressing signals to the first and second display sections includes applying image independent addressing signals to the first electrodes of each display section and image-dependent signals to the second electrodes of each display section.

15. The method of claim 14 in which applying image-independent addressing signals to the first electrodes includes applying to the first electrodes of each display section addressing signals that cause multiple selections in the corresponding frame periods.

16. The method of claim 14 in which storing display information in the first, second, and third memory areas includes storing information corresponding to the image-dependent, second electrode addressing signals.

17. The method of claim 12 in which storing display information corresponding to a first and second portion of a first image includes storing image data.

* * * * *